US009955804B2

(12) United States Patent
Fulkerson et al.

(10) Patent No.: US 9,955,804 B2
(45) Date of Patent: May 1, 2018

(54) LATEX FOAM PILLOW

(71) Applicant: Sealy Technology, LLC, Trinity, NC (US)

(72) Inventors: Michael J. Fulkerson, Pocono Summit, PA (US); Edward K. Wolff, Pottsville, PA (US); Angela Li, Mountain Top, PA (US)

(73) Assignee: Sealy Technology, Trinity, NC (US)

( * ) Notice: Subject to any disclaimer, the term of this patent is extended or adjusted under 35 U.S.C. 154(b) by 0 days. days.

(21) Appl. No.: 14/773,498

(22) PCT Filed: Mar. 7, 2014

(86) PCT No.: PCT/US2014/021637
§ 371 (c)(1),
(2) Date: Sep. 8, 2015

(87) PCT Pub. No.: WO2014/138552
PCT Pub. Date: Sep. 12, 2014

(65) Prior Publication Data

US 2016/0022063 A1 Jan. 28, 2016

Related U.S. Application Data

(60) Provisional application No. 61/774,808, filed on Mar. 8, 2013, provisional application No. 61/777,468, filed
(Continued)

(51) Int. Cl.
*A47C 20/00* (2006.01)
*A47G 9/10* (2006.01)
(Continued)

(52) U.S. Cl.
CPC ..... *A47G 9/10* (2013.01); *A47C 31/001* (2013.01); *A47C 16/00* (2013.01); *A47G 9/1054* (2013.01);
(Continued)

(58) Field of Classification Search
CPC ..... A47C 31/001; A47C 16/00; A47G 2009/1018; A47G 9/10; A47G 9/1027;
(Continued)

(56) References Cited

U.S. PATENT DOCUMENTS 5,138,732 A 8/1992 Wattie et al.
8,656,537 B2 * 2/2014 Leifermann ..... A47G 9/0253 5/636
(Continued)

FOREIGN PATENT DOCUMENTS

JP 2012-81094 A 4/2012
KR 10-2010-0107889 A 10/2010
WO WO 01-80690 A1 11/2001

OTHER PUBLICATIONS

International Searching Authority, International Search Report and Written Opinion, dated Jul. 12, 2014, 11 pgs,.

*Primary Examiner* — David E Sosnowski
*Assistant Examiner* — Morgan McClure
(74) *Attorney, Agent, or Firm* — Middleton Reutlinger

(57) ABSTRACT

A pillow is provided that includes a latex foam to provide comfort and support to the body of a user. The pillow includes a latex foam layer connected to at least one additional foam component. An internal foam layer is also included in the pillow, with the latex foam layer and the additional foam component disposed about the internal foam layer.

16 Claims, 4 Drawing Sheets

Related U.S. Application Data on Mar. 12, 2013, provisional application No. 61/791, 583, filed on Mar. 15, 2013.

(51) Int. Cl.
*A47C 31/00* (2006.01)
*A47C 16/00* (2006.01)

(52) U.S. Cl.
CPC ..... *A47G 9/1072* (2013.01); *A47G 9/1081* (2013.01); *A47G 2009/1018* (2013.01)

(58) Field of Classification Search
CPC .. A47G 9/1018; A47G 9/1054; A47G 9/1072; A47G 9/1045; A47G 9/1081
See application file for complete search history.

(56) References Cited

U.S. PATENT DOCUMENTS

| | | | | |
|---|---|---|---|---|
| 8,991,921 | B2 * | 3/2015 | Peterson | A47C 1/023 297/284.1 |
| 2002/0078507 | A1 * | 6/2002 | Pearce | A47C 3/16 5/644 |
| 2005/0278852 | A1 * | 12/2005 | Wahrmund | A47C 27/05 5/636 |
| 2006/0059628 | A1 * | 3/2006 | Hamilton | A47C 4/52 5/653 |
| 2012/0102654 | A1 | 5/2012 | Lee | |
| 2012/0204350 | A1 * | 8/2012 | Katsnelson | A47G 9/1027 5/644 |

* cited by examiner

LATEX FOAM PILLOW

RELATED APPLICATIONS

This application claims priority to U.S. Provisional Application Ser. No. 61/774,808, filed Mar. 8, 2013; U.S. Provisional Application Ser. No. 61/777,468, filed Mar. 12, 2013; and U.S. Provisional Application Ser. No. 61/791,583, filed Mar. 15, 2013, the entire disclosures of each of which are incorporated herein by this reference.

TECHNICAL FIELD

The present invention relates to pillows having a latex foam layer and at least one additional foam component. In particular, the present invention relates to pillows including a latex foam layer and an additional foam component that are each disposed about an internal foam layer to provide comfort and support to the body of a user, or a portion thereof, resting on the pillow.

BACKGROUND

As is generally the case with pillows, the effectiveness and desirability of the pillow is partly a function of well the pillow supports the body of a user and partly a function of how well the pillow conforms to the body of a user and provides a feeling of softness. In this regard, many users find pillows comprised of latex foam to be particularly desirable, as such pillows provide an increased amount of support to the body of a user and offer an orthopedically correct sleeping position that reduces and prevents pain in the body of a user, or a portion thereof, resting on such a pillow. That increased amount of support, however, is often accompanied by an increased amount of heat retention in that latex pillow, as well as an increased cost that leaves many users looking for suitable alternatives to latex foam pillows.

SUMMARY

The present invention includes pillows having a latex foam layer and at least one additional foam component. In particular, the present invention relates to pillows including a latex foam layer and an additional foam component that are each disposed about an internal foam layer to provide comfort and support to the body of a user, or a portion thereof, resting on the pillow.

In one exemplary embodiment of the present invention, a pillow is provided that includes an internal foam layer having a first surface and a second surface. The pillow also includes a latex foam layer, along with an additional foam component in the form of a flexible foam layer, that are each disposed about the internal foam layer. The latex foam layer is generally comprised of a planar piece of flexible latex foam having a first abutment end and a second abutment end. The flexible foam layer, on the other hand, can be comprised of a variety of different foams and includes a first mating end, which is connected to the first abutment end of the latex foam layer, and a second mating end, which is connected to the second abutment end of the latex foam layer. In this regard, once connected, the latex foam layer and the flexible foam layer thus form a continuous outer foam layer that substantially surrounds the internal foam layer of the pillow.

By wrapping the latex foam layer and the additional foam component (or flexible foam layer) around the internal foam layer, the latex foam layer and the flexible foam layer are generally positioned and configured to both form the longitudinal edges of the pillow as well as the support surfaces of the pillow. For example, in some embodiments, the latex foam layer forms a first longitudinal edge of the pillow, and the flexible foam layer forms a second longitudinal edge of the pillow, with both the first longitudinal edge and the second longitudinal edge of the pillow having an arcuate shape. In some embodiments, the latex foam layer and the flexible foam layer can further be positioned such that the latex foam layer substantially covers the first surface of the internal foam layer and the flexible foam layer substantially covers the second surface of the internal foam layer. In this regard, in some embodiments, the latex foam layer and the flexible foam layer each form a support surface of the pillow.

Regardless of the particular configuration, the latex foam layer, the internal foam layer, and the additional foam component (or flexible foam layer) are each generally comprised of a foam that is capable of suitably distributing the pressure from to user's body, or portion thereof, across the pillow. In some embodiments, the internal foam layer, the additional flexible foam layer, or both are comprised of a visco-elastic foam. In certain embodiments, the latex foam of the latex foam layer has a hardness, density, or both that is different than that of the flexible foam layer, such that a pillow can be provided where one support surface of the pillow provides a softer surface on which to rest, while the other support surface of the pillow provides a desired amount of support. In further embodiments, the internal foam layer has a hardness, density, or both that is different from the latex foam layer, the flexible foam layer, or both to further modify the feel and comfort of the pillow (e.g., softer or more firm).

To further enhance the comfort, in some embodiments, the pillow further includes one or more additional features to increase the comfort of a user lying on the pillow. For example, in some embodiments, to increase the movement of air through the pillow and reduce the retention of heat in the pillow, the latex foam layer defines a plurality of columnar voids that extend through the latex foam layer and are in fluid communication with the internal foam layer to allow for an increased amount of air to travel through and dissipate heat away from the internal foam layer and the remainder of the pillow.

In addition to having a plurality of columnar voids that provide enhanced air flow, in some embodiments, the pillow includes an outer cover that surrounds the latex foam layer and the flexible foam layer. Such an outer cover is typically comprised of a textile having a sufficient amount of durability, but that also has a sufficient amount of breathability to allow air and heat to travel through the outer cover and away from the pillow. For instance, in some embodiments, the outer cover is comprised of one hundred percent cotton.

Further features and advantages of the present invention will become evident to those of ordinary skill in the art after a study of the description, figures, and non-limiting examples in this document.

DESCRIPTION OF EXEMPLARY EMBODIMENTS

Figure 2:
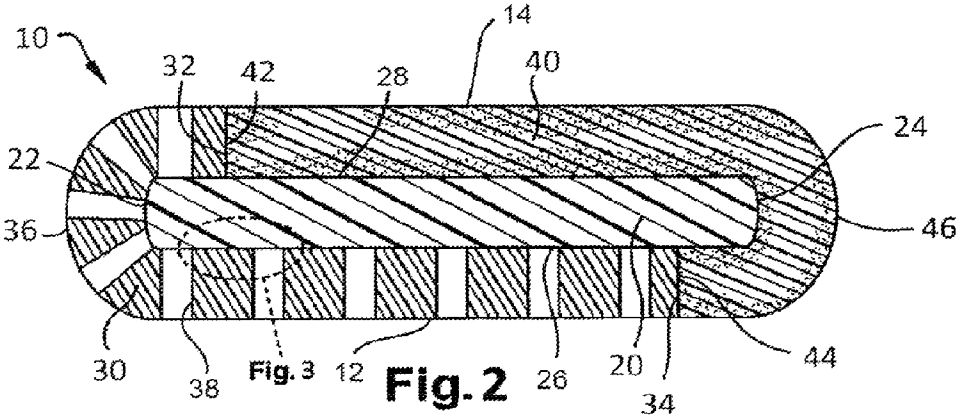
FIG. 2 is a cross-sectional view of the exemplary pillow of FIG. 1 taken along line 2-2 of FIG. 1.

The present invention includes pillows having a latex foam layer and at least one additional foam component. In particular, the present invention relates to pillows including a latex foam layer and an additional foam component that are each disposed about an internal foam layer to provide comfort and support to the body of a user, or a portion thereof, resting on the pillow.

Referring first to FIGS. 1-4, in one exemplary embodiment of the present invention, a pillow 10 is provided that includes an internal foam layer 20 having a first surface 26 and a second surface 28. The pillow 10 also includes a latex foam layer 30 and an additional foam component, in the form of a flexible foam layer 40, that are each disposed about the internal foam layer 20. The latex foam layer 30 is comprised of a substantially rectangular piece of flexible latex foam having a first abutment end 32 and a second abutment end 34 opposite the first abutment end 32. The flexible foam layer 40 is similarly comprised of a substantially rectangular piece of foam, and includes a first mating end 42, which is connected to the first abutment end 32 of the latex foam layer 30, and a second mating end 44, which is connected to the second abutment end 34 of the latex foam layer 30. In this regard, by connecting the first mating end 42 of the flexible foam layer 40 to the first abutment end 32 of the latex foam layer 30, and by connecting the second mating end 44 of the flexible foam layer 40 to the second abutment end 34 of the latex foam layer 30, the latex foam layer 30 and the flexible foam layer 40 thus form a continuous outer foam layer that substantially surrounds the internal foam layer 20 of the pillow 10.

By positioning and configuring the latex foam layer 30 and the flexible foam layer 40 around the internal foam layer 20, the latex foam layer 30 and the flexible foam layer 40 generally form both the longitudinal edges of the pillow, as well as the support surfaces of the pillow. In particular, in the exemplary embodiment shown in FIGS. 1-4, the latex foam layer 30 forms a first longitudinal edge 36 of the pillow 10, and the flexible foam layer 40 forms a second longitudinal edge 46 of the pillow 10. Both the first longitudinal edge 36 and the second longitudinal edge 46 have an arcuate shape by virtue of the connection of the first and second abutment ends 32, 34 of the latex foam layer 30 with the mating ends 42, 44 of the flexible foam layer 40, and by virtue of positioning the internal foam layer 20 in the internal cavity created by the latex foam layer 30 and the flexible foam layer 40.

Additionally, in the exemplary embodiment shown in FIGS. 1-4, the latex foam layer 30 is positioned such that it substantially covers the first surface 26 of the internal foam layer 20 and forms a first support surface 12 of the pillow 10, while the flexible foam layer 40 is positioned such that is substantially covers the second surface 28 of the internal foam layer 20 and forms a second support surface 14 of the pillow 10. In this regard, the latex foam layer 30 and the flexible foam layer 40 of the pillow 10 are thus positioned and configured to provide two different support surfaces 12, 14 of the pillow 10, thereby providing a pillow 10 that provides a different feel to a user resting on the pillow 10 depending on whether the user is resting their body, or a portion thereof, on the first support surface 12 or second support surface 14 of the pillow 10, as described in further detail below.

Referring still to FIGS. 1-4, the internal foam layer 20 is a substantially rectangular piece of foam having a first longitudinal edge 22 and a second longitudinal edge 24 opposite the first longitudinal edge 22. The first longitudinal edge 22 of the internal foam layer 20 is positioned adjacent to first longitudinal edge 36 of the pillow 10, and the second longitudinal edge 24 of the internal foam layer 20 is positioned adjacent to the second longitudinal edge 46 of the pillow 10. The result is a pillow 10 with a generally rectangular shape with both the first longitudinal edge 36 and the second longitudinal edge 46 having an arcuate shape. However, it is contemplated that the internal foam layer 20 could also have other shapes including contoured, curvilinear or non-planar shapes, which would result in a different overall shape of the pillow 10. For example, if the internal foam layer 20 had a cylindrical shape and was positioned in the internal cavity created by the latex foam layer 30 and the flexible foam layer 40, the overall pillow 10 would also have a cylindrical shape.

Regardless of the particular configuration, the latex foam layer 30, the internal foam layer 20, and the flexible foam layer 40 are each generally comprised of a foam that is capable of suitably distributing the pressure from a user's body or portion thereof across the pillow 10. Such foams include, but are not limited to, latex foam, reticulated or non-reticulated visco-elastic foam (sometimes referred to as memory foam or low-resilience foam), reticulated or non-reticulated non-visco-elastic foam, polyurethane high-resilience foam, soy foam, expanded polymer foams (e.g., expanded ethylene vinyl acetate, polypropylene, polystyrene, or polyethylene), and the like. Furthermore, the foams may include gel additives or inserts.

Of course, the latex foam layer 30 of the pillow 10 is comprised primarily of latex foam. Latex is a stable dispersion (emulsion) of polymer microparticles in an aqueous medium, with the microparticles preferably having a size range of about 10 to 1000 nm. Latexes may be natural or synthetic. Thus, the latex foam for the latex foam layer 30 of the pillow 10 can be prepared, for example, from natural rubber latex or from one or more of such synthetic latexes, such as polybutadiene/styrene latex, polybutadiene/acrylonitrile latex, polychloroprene latex and the like, or from a mixture of natural rubber latex and one or more such synthetic latexes. In this regard, the latex foam for the latex foam layer 30 of the pillow 10 may include conventional latex foams, as well as visco-elastic latex foams. In some embodiments, the solids content of the latex foam is from about 20 to 75% by weight. In other embodiments, the solids content of the latex foam is from about 50 to 75% by weight.

With respect to the internal foam layer 20 and the flexible foam layer 40, one or both are generally comprised of a foam that is different that the latex foam of the latex foam layer 30. For example, one or both of the internal foam layer 20 and the flexible foam layer 40 could be comprised of as visco-elastic foam. Generally, a visco-elastic foam capable of use in an exemplary pillow of the present invention has a hardness of at least about 10 N to no greater than about 80 N, as measured by exerting pressure from a plate against a sample of the material to a compression of at least 40% of an original thickness of the material at approximately room temperature (i.e., 21° C. to 23° C.), where the 40% compression is held for a set period of time as established by the International Organization of Standardization (ISO) 2439 hardness measuring standard. In some embodiments, the visco-elastic foam used in one or both of the internal foam layer 20 and the flexible foam layer 40 in the pillow 10 has hardness of about 10 N, about 20 N, about 30 N, about 40 N, about 50 N, about 60 N, about 70 N, or about 80 N to provide a desired degree of comfort and body-conforming qualities.

To the extent that visco-elastic foam is used in one or both of the internal foam layer 20 and the flexible foam layer 40, the visco-elastic foam can also have as density that assists in providing a desired degree of comfort and body-conforming qualities, as well as an increased degree of material durability. In some embodiments, the visco-elastic foam used in one or both of the internal foam layer 20 and the flexible foam layer 40 in the pillow 10 is no less than about 30 kg/m$^3$ to no greater than about 150 kg/m$^3$. In some embodiments, the density of the visco-elastic foam is about 30 kg/m$^3$, about 40 kg/m$^3$, about 50 kg/m$^3$, about 60 kg/m$^3$, about 70 kg/m$^3$, about 80 kg/m$^3$, about 90 kg/m$^3$, about 100 kg/m$^3$, about 110 kg/m$^3$, about 120 kg/m$^3$, about 130 kg/m$^3$, about 140 kg/m$^3$, or about 150 kg/m$^3$.

In one exemplary embodiment, and as shown FIGS. 1-4, to provide varied levels of comfort and support, the density or hardness of the latex foam layer 30 and the density or hardness of the flexible foam layer 40 are not the same. For example, in certain embodiments, the latex foam layer 30 has a density greater than the density of the flexible foam layer 40, such that the first longitudinal edge 36 and first support surface 12 of the pillow 10, which is formed by the latex foam layer 30, is configured to provide a firm surface for the user to rest his or her body, or as portion thereof, while the second longitudinal edge 46 and second support surface 14 of the pillow, which is formed of the less dense flexible foam layer 40 provides a softer surface.

Figure 1:
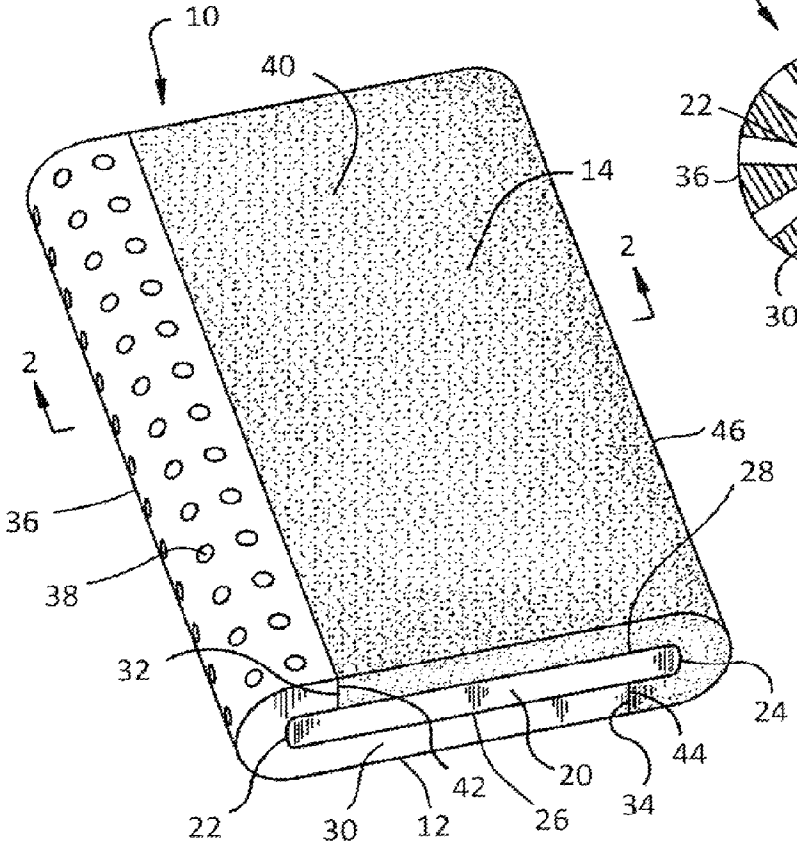
FIG. 1 is a perspective view of an exemplary pillow made in accordance with the present invention.

Furthermore, in some embodiments, the density or hardness of the internal foam layer 20 is not the same as the density or hardness of the latex foam layer 30, the flexible foam layer 40, or both the latex foam layer 30 and the flexible foam layer 40. For example, as shown in FIGS. 1-2, the body of a user, or a portion thereof, positioned on the first or second support surfaces 12, 14 of the pillow 10 would be supported by multiple layers of foam, i.e., the internal foam layer 20, the latex foam layer 30, and the flexible foam layer 40. The different densities and/or hardnesses of the foam layers 20, 30, 40 allows for even greater variation in the levels of comfort and support provided by the pillow 10. For example, in the exemplary pillow 10 shown in FIGS. 1-4, the density of the internal foam layer 20 is greater than the density of the latex foam layer 30, and the flexible foam layer 40, to thereby provide stiffness and support in the middle of the pillow 10. As such, the first support surface 12, in combination with the underlying dense internal foam layer 20, would provide a greater amount of support to the body of the user than the first longitudinal edge 36, which is comprised only of the less dense latex foam layer 30. Similarly, the second support surface 14 would provide greater support to the body of the user than the second longitudinal edge 46.

Of course, the selection of foams having a particular density or hardness will affect other characteristics of the foam, including the manner in which the foam responds to pressure and the overall feel of the foam. It should be appreciated though that a foam having a desired density and hardness can readily be selected for a particular application or support cushion (e.g., pillow) as desired.

Figure 3:
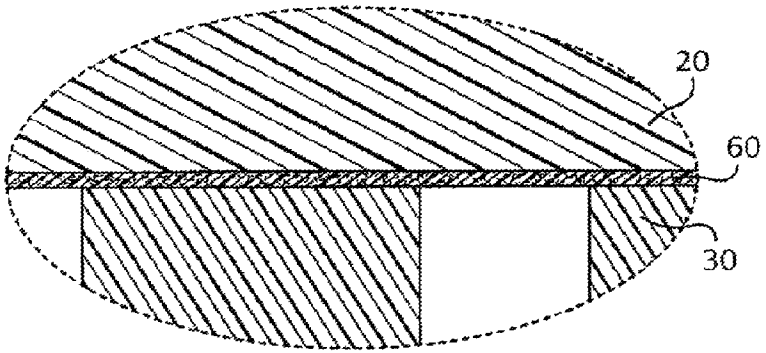
FIG. 3 is an enlarged, partial cross-sectional view of the exemplary pillow of FIG. 1 showing an adhesive area of the pillow.
Figure 4:
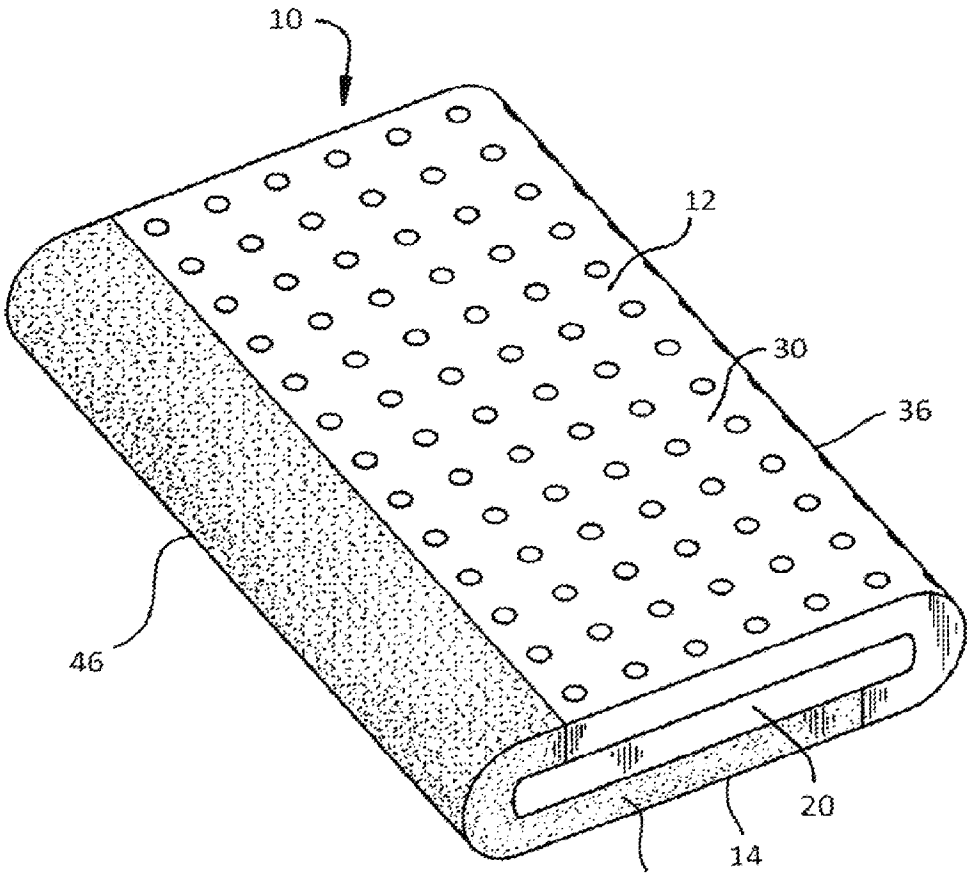
FIG. 4 is an another perspective view of the exemplary pillow of FIG. 1.

Referring still to FIGS. 1-4, in this exemplary embodiment, and as a further refinement, the latex foam layer 30 defines a plurality of columnar voids 38 that extend through the latex foam layer 30 and are in fluid communication with the internal foam layer 20. The columnar voids 38 allow for air to more readily travel through the latex foam layer 30 and for heat retained by the pillow 10 to more readily dissipate away from the pillow 10. As best shown in FIG. 4, the columnar voids 38 are arranged in a regular grid-like pattern throughout the latex foam layer 30 to help ensure uniform movement of air and a uniform dissipation of heat away from the internal foam layer 20 and the remainder of the pillow 10. However, it is also contemplated that voids having various sizes and shapes could also be included in an exemplary pillow, as may be desired for a particular application or user, without departing from the spirit and scope of the present invention. For example, for users prone to excessive heating during sleep, it is contemplated that an exemplary pillow could be provided having voids with larger diameters positioned in a central region of the pillow that would be in contact with the portion of the body of the user that is prone to excessive heating.

Although not shown in FIGS. 1-4, as a further refinement, to enhance the comfort of the pillow 10, the pillow 10 may also be provided with an outer cover (or pillowcase) that surrounds the pillow 10. Such an outer cover is typically comprised of a textile having a sufficient amount of durability to protect the underlying the pillow, but also having a sufficient amount of "breathability" to allow air and heat to travel through the outer cover. In some embodiments, the outer cover is comprised of one hundred percent cotton, which typically allows for sufficient movement of air through the pillow. In some embodiments, the outer cover can also include an amount of a flame-retardant material, such that a flame-retardant barrier surrounds and protects the foam of the underlying pillow. Of course, numerous other textiles, including silk and textiles having a lower percentage of cotton, could also be readily used to fabricate an outer cover without departing from the spirit and scope of the present invention.

Referring again to the exemplary embodiment shown in FIGS. 1-4, the foam layers 20, 30, 40 of the pillow preferably have different densities and/or hardnesses. As the pillow 10 could be susceptible to shifts in the foam layers 20, 30, 40 with respect to one another, adhesive areas are used to stabilize the internal foam layer 20, the latex foam layer 30, and the flexible foam layer 40 with respect to one another. The adhesive areas comprise a material mimicking the properties and chemical makeup of the adhering surfaces to avoid any type of barrier or harder area which would provide discomfort to a user or would impart adverse properties on the final construction of the pillow. For example, in certain embodiments, a latex adhesive is used, as further described below.

FIG. 3 is an enlarged, partial cross-sectional view of the exemplary pillow of FIG. 1 showing an adhesive area of the pillow. As shown, in this exemplary embodiment, the latex foam layer 30 adheres to internal foam layer 20, and the adhesive area is an adhesive layer 60 comprised of a chemical or compound with chemical or mechanical properties similar to both the latex foam layer 30 and the internal foam layer 20. Thus, the adhesive layer 60 becomes intertwined or bonded within the top layer or surface of latex foam layer 30 and the internal foam layer 20. The chemical properties of the adhesive layer 60 are close enough to the surrounding layers 20, 30 of foam that the surfaces of the latex foam layer 30 and the internal foam layer 20 interact to create a nearly indistinguishable bond.

In some embodiments, where there is an adhesive area between two layers of a latex foam, a latex adhesive is used. When cured or dried, the latex adhesive has a flexibility and plasticity that is very close to that of the material of the surrounding latex foam layers. Accordingly, when the latex adhesive is cured/dried, the latex component of the adhesive is the same as or closely similar to the latex in the foam layers, so that the presence of the adhesive between the layers of latex foam, or between latex foam and another type or types of foam, is imperceptible. In other words, the latex adhesive acts homogeneously with latex-containing foam, so that the presence of adhesive or an adhesive layer or boundary is imperceptible.

In some embodiments, such a latex adhesive is made from latex, a thickener and a cure package. In some embodiments, the latex is primarily a natural latex. In other embodiments, the latex is a mixture of from 80-100% natural latex and from 0-20% synthetic latex. The cure package typically is made from cure-related items and other additive materials which initiate and control the curing process and bring other desirable properties to the final latex adhesive. The thickener is chosen for its ability to increase the viscosity of the compound.

While various embodiments are possible and are directly related to the ultimate properties desired, in one particular exemplary embodiment, the following formulations and ratios are used:

TABLE 1

| | Weight Percent |
|---|---|
| Latex | 80.0 to 98.7% |
| Master-batch/Cure Package | 1.0 to 10.0% |
| Thickener | 0.3 to 10.0% |

In an alternative embodiment, the thickener comprises 0.5% to 5.0% of the total weight of the latex adhesive. In some embodiments, the thickener is a polyacrylate, which increases the viscosity of the latex adhesive. In other embodiments, the thickener is any suitable material which can increase the viscosity of the latex compound, while still allowing the latex adhesive to retain its overall properties and integrity. Typically, the thickener is white, clear, or neutral in color.

In another alternative embodiment, the cure package comprises 2.0% to 7.0% of the total weight of the latex adhesive. In some embodiments, the cure package is a synthetic and/or natural rubber latex vulcanization package consisting of sulfur, zinc oxide, accelerators, accelerator activator and antioxidant to promote vulcanization with heat and protect the finished latex adhesive from oxidative aging.

In one particular exemplary embodiment, the cure package itself includes the following formulation and ratios:

TABLE 2

| | Weight Percent |
|---|---|
| Sulfur | 15-40% |
| ZnO | 20-45% |
| Accelerator(s) | 15-45% |
| Accelerator Activator (s) | 0-20% |

The latex (natural and synthetic), master-batch/cure system, and thickener are mixed or combined to form a latex adhesive which can be used anywhere a soft pliable glue bond is required such as, but not limited to, a latex to latex bond, latex to foam bond, fiber to foam bond, and foam to foam bond. In some embodiments, the latex adhesive is applied at an elevated temperature (heat), or, in some other embodiments, at room temperature. The main goal of the latex adhesive is to mimic the viscoelastic properties of the two adhering surfaces and, in turn, avoiding a hard layered surface or seam which, in some instances, is undesirable.

The latex adhesive can be applied to the surfaces in a variety of manners based on the application involved or the machinery available for production. In some embodiments, the latex adhesive is sprayed onto the surfaces with a spray gun. In other embodiments, the latex adhesive is applied with one or more brushes, rollers spongers, or other such applicators. In still other embodiments, the latex adhesive is poured onto one or more surfaces and spread as needed. In other embodiments, the latex adhesive is adhered in a sheet-like manner. In other embodiments, the latex adhesive is used in a gel-like application. In other embodiments, the latex adhesive is applied at or near room temperature, while, in other embodiments, heat is used to activate and start the curing and bonding process.

In some embodiments, the latex adhesive has a density and hardness that provides good performance and adhesion results while in use, but also, after setting, has characteristics related to comfort of the user. In this regard, the latex adhesive does not harden over time, as such hardening can compromise the comfort of the final user, particularly when one or more layers are utilized or one or more adhesive layers 60 are used.

Figure 5:
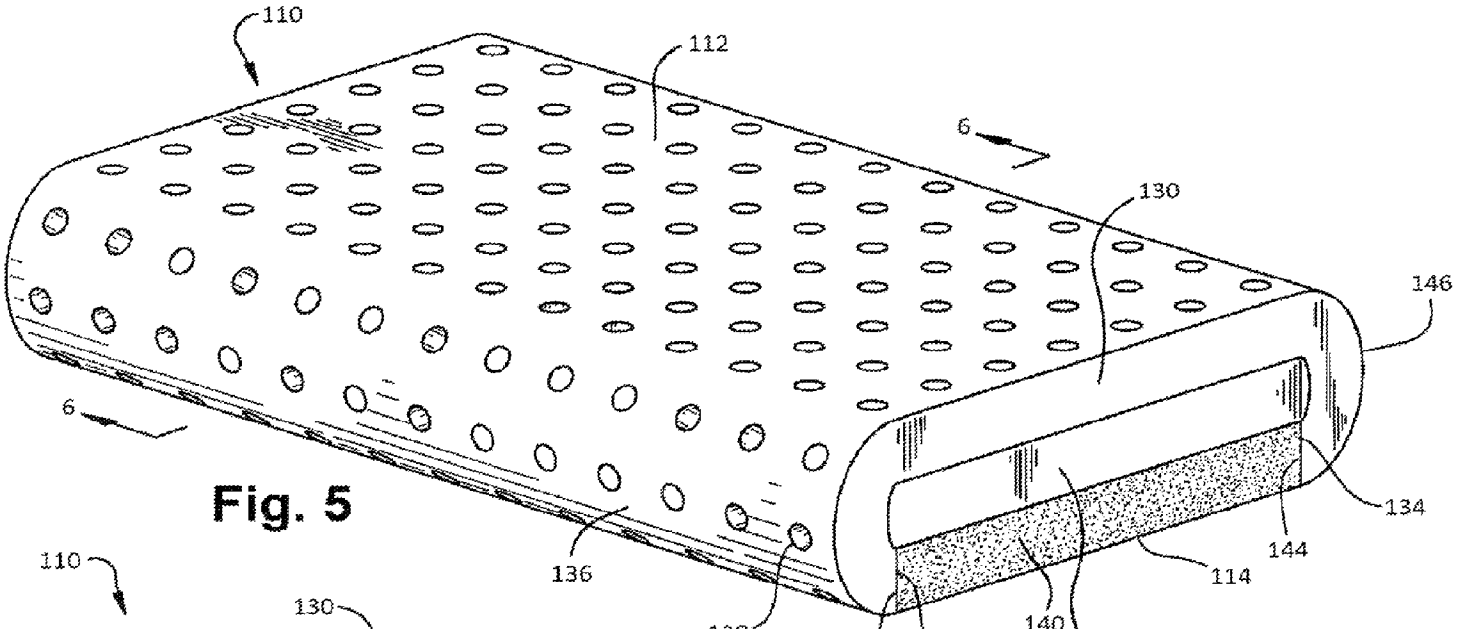
FIG. 5 is a perspective view of another exemplary pillow made in accordance with the present invention.
Figure 6:
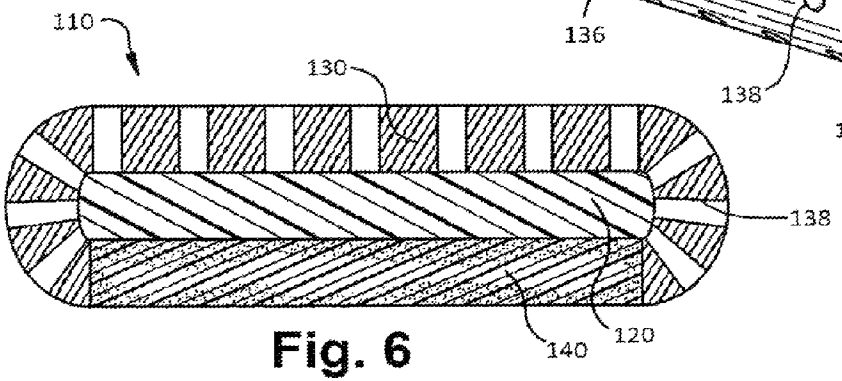
FIG. 6 is a cross-sectional view of the pillow of FIG. 5 taken along line 6-6 of FIG. 5.

With further respect to the use of different foam layers in an exemplary pillow of the present invention, and referring now to FIGS. 5-6, in another exemplary embodiment of the present invention, a pillow 110 is provided that, like the pillow 10 shown in FIGS. 1-4, includes an internal foam layer 120, a flexible foam layer 140, and a latex foam layer 130 that defines a plurality of columnar voids 138. Also, like the pillow 10 shown in FIGS. 1-4, the latex foam layer 130 is connected by first and second abutment ends 132, 134 to first and second mating ends 142, 144 of the flexible foam layer 140 to form a continuous outer foam layer that substantially surrounds the internal foam layer 120. Furthermore, the latex foam layer 130 of the pillow 110 also forms a first support surface 112 of the pillow 110 and the flexible foam layer 140 forms a second support surface 114 of the pillow 110. Unlike the pillow shown in FIGS. 1-4, however, the latex foam layer 130 forms both a first longitudinal edge 136 and a second longitudinal edge 146 of the pillow 110.

Figure 7:
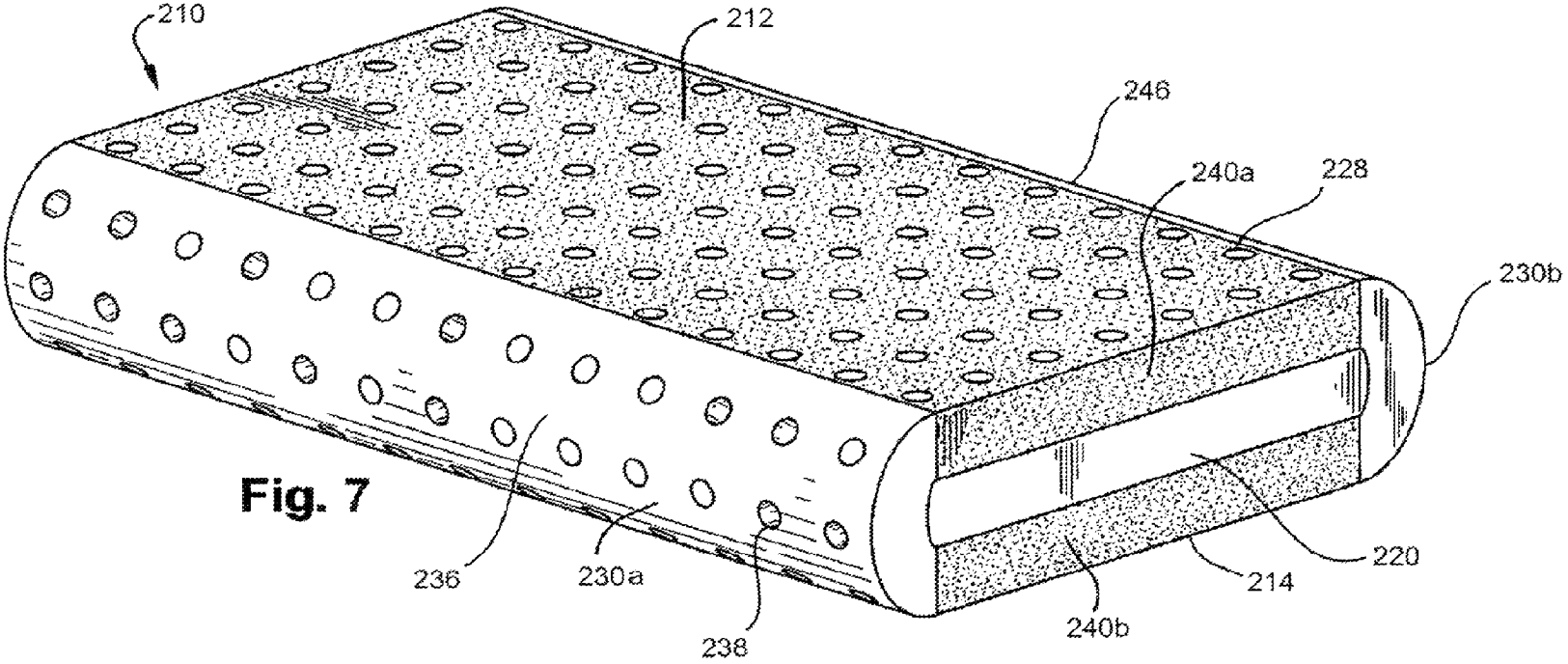
FIG. 7 is as perspective view of another exemplary pillow made in accordance with the present invention.

Referring now to FIG. 7, in yet another exemplary embodiment of the present invention, a pillow 210 is provided that also includes an internal foam layer 120. Unlike the pillows 10, 110 shown in FIGS. 1-4 and 5-6, however, the pillow 210 does not make use of a single flexible foam layer and a single latex foam layer. Rather, the pillow 10 includes a first flexible foam layer **240*a* and a second flexible foam layer 240*b* that form the first support surface 212 and the second support surface 214 of the pillow 210, respectively. Also, unlike the pillows 10, 110 shown in FIGS. 1-4 and 5-6, the pillow 210 also includes a first latex foam layer 230*a* that forms a first longitudinal edge 236 of the pillow 210, and a second latex foam layer 230*b* that forms a second longitudinal edge 238 of the pillow 210. Furthermore, as also shown in FIG. 7, both the first latex layer 230*a* and the first flexible foam layer 240*a* define a plurality of columnar voids 238 to dissipate heat away from the internal foam layer 220 and the remainder of the pillow 210**.

As yet another refinement of the present invention, although the embodiments shown in FIGS. 1-7 are in the form of pillows and will typically have a width in a range of 20 to 50 inches, a length in a range of 20 to 50 inches, and a thickness in a range of 1 to 6 inches such that the pillows are dimensionally-sized to support the head of a user, it is contemplated that the features described herein are equally applicable to numerous other support cushions and the like. Such additional support cushions can include, but are not limited to, mattresses, seat cushions, seat backs, neck pillows, leg spacer pillows, mattress toppers, overlays and the like. As such, the phrase "support cushion" can be used herein to refer to any and all such objects having any size and shape, and that are generally capable of or are generally used to support the body of a user of a portion thereof.

The following list of references are incorporated herein by reference:

REFERENCES

1. U.S. Pat. No. 8,034,445 to Landvik, et al., issued Oct. 11, 2011, and entitled "Laminated Visco-Elastic Support."
2. U.S. Pat. No. 8,025,964 to Landvik, et al., issued Sep. 27, 2011, and entitled "Laminated Visco-Elastic Support."
3. U.S. Pat. No. 7,794,507 to Bishop et al., issued Sep. 14, 2010, and entitled "Textile Treatment."
4. U.S. Pat. No. 7,735,169 to Wassilefsky, issued Jun. 15, 2010, and entitled "Comfort Pillow."
5. U.S. Pat. No. 7,707,670 to Fogg, issued May 4, 2010, and entitled "Pillow top for a Cushion."
6. U.S. Pat. No. 7,507,468 to Landvik, et al., issued Mar. 24, 2009, and entitled "Laminated Visco-Elastic Support."
7. U.S. Pat. No. 7,444,702 to Fogg, issued Nov. 4, 2008, and entitled "Pillow top for a Cushion."
8. U.S. Pat. No. 7,415,742 to Wassilefsky, issued Aug. 26, 2008, and entitled "Comfort Pillow."
9. U.S. Design Pat. No. D558,499 to Maarbjerg, issued Jan. 1, 2008, and entitled "Pillow."
10. U.S. Pat. No. 7,155,765 to Fogg, issued Jan. 2, 2007, and entitled "Pillow top for a Cushion."
11. U.S. Design Pat. No. D529,325 to Maarbjerg, issued Oct. 3, 2006, and entitled "Pillow."
12. U.S. Pat. No. 7,082,633 to Maarbjerg issued Aug. 1, 2006 and entitled "Pillow."
13. U.S. Pat. No. 7,051,389 to Wassilefsky, issued May 30, 2006, and entitled "Comfort Pillow."
14. U.S. Pat. No. 6,866,915 to Landvik, issued Mar. 15, 2005, and entitled "Cushion."
15. U.S. Pat. No. 6,602,579 to Landvik, issued Aug. 5, 2003, and entitled "Cushion."
16. U.S. Pat. No. 6,578,218 to Wassilefsky, issued Jun. 17, 2003, and entitled "Leg Spacer Pillow."
17. U.S. Pat. No. 6,541,094 to Landvik, et al., issued Apr. 1, 2003, and entitled "Laminated Visco-Elastic Support."
18. U.S. Design Pat. No. D456,660 to Landvik, issued May 7, 2002, and entitled "Contoured Head Pillow."
19. U.S. Patent Application Publication No. 2007/0094803 by Fogg, published May 3, 2007, and entitled "Pillow top for a Cushion."
20. U.S. Patent Application Publication No. 2006/0277684 by Wassilefsky, published Dec. 14, 2006, and entitled "Comfort Pillow."
21. U.S. Patent Application Publication No. 2006/0174414 by Maarbjerg, published Aug. 10, 2006, and entitled "Pillow."
22. U.S. Patent Application Publication No. US2005/0202214 by Landvik, published Sep. 15, 2005, and entitled "Cushion."
23. U.S. Patent Application Publication No. 2005/0084667 by Landvik, et al., published Apr. 21, 2005, and entitled "Laminated Visco-Elastic Support."
24. U.S. Patent Application Publication No. 2005/0076446 by Fogg, published Apr. 14, 2005, and entitled "Pillow top for a Cushion."
25. U.S. Patent Application Publication. No. 2004/0033351 by Landvik, et al., published Feb. 19, 2004, and entitled "Laminated Visco-Elastic Support."
26. U.S. Patent Application Publication No. 2001/0021438 by Landvik, published Sep. 13, 2001, and entitled "Cushion."

One of ordinary skill in the art will recognize that additional embodiments are also possible without departing from the teachings of the present invention or the scope of the claims which follow. This detailed description, and particularly the specific details of the exemplary embodiments disclosed herein, is given primarily for clarity of understanding, and no unnecessary limitations are to be understood therefrom, for modifications will become apparent to those skilled in the art upon reading this disclosure and may be made without departing from the spirit or scope of the claimed invention.

What is claimed is:

1. A pillow, comprising:

an internal foam layer having a first upper surface and a second lower surface opposite the first upper surface, the first upper surface and the second lower surface of the internal foam layer extending from a first longitudinal edge of the internal foam layer to a second longitudinal edge of the internal foam layer;

a latex foam layer having an upper surface partially covering the first upper surface of the internal foam layer, a lower surface partially covering the second lower surface of the internal foam layer, and a side surface directly connecting and located between the upper and lower surfaces of the internal foam layer, the latex foam layer further comprising a first plurality of columnar voids substantially perpendicular to the internal foam layer positioned on one of the upper and lower surface of the latex foam layer, and a second plurality of columnar voids on the side surface of the latex foam layer which are angled with respect to the first columnar voids having a first end proximate to and directly abutting the internal foam layer and a second end opposite the first end and spaced from the internal foam layer; and an additional foam layer devoid of columnar voids and having a lower surface partially covering the second lower surface of the internal foam layer, an upper surface partially covering the first upper surface of the internal foam layer, and a side surface directly connected to and located between the upper and lower surfaces of the internal foam layer, the additional foam layer being directly connected with the latex foam layer such that the latex foam layer and the additional foam layer are disposed about the internal foam layer.

2. The pillow of claim 1, wherein the latex foam layer includes a first abutment end which extends about the first longitudinal end and a second abutment end which extends about a second longitudinal end, and wherein the additional foam layer is a flexible foam layer having a first mating end and a second mating end, the first mating end of the flexible foam layer connected to the first abutment end of the latex foam layer, and the second mating end of the flexible foam layer connected to the second abutment end of the latex foam layer, such that the latex foam layer and the flexible foam layer are continuous around the internal foam layer.

3. The pillow of claim 2, wherein the first mating end of the flexible foam layer is adhesively bonded to the first abutment end of the latex foam layer, and wherein the second mating end of the flexible foam layer is adhesively bonded to the second abutment end of the latex foam layer.

4. The pillow of claim 2, wherein the latex foam layer and the flexible foam layer are adhesively bonded to the internal foam layer.

5. The pillow of claim 2, wherein the internal foam layer, the flexible foam layer, or both are comprised of a latex foam.

6. The pillow of claim 2, wherein the internal foam layer, the flexible haw layer, or both are comprised of a visco-elastic foam.

7. The pillow of claim 2, further comprising a cover surrounding the latex foam layer and the flexible foam layer.

8. The pillow of claim 1, wherein the latex foam layer forms the first longitudinal edge of the pillow and the additional foam layer forms the second longitudinal edge of the pillow.

9. The pillow of claim 8, wherein the first longitudinal edge f the pillow and the second longitudinal edge of the pillow each have an arcuate shape.

10. The pillow of claim 1, wherein the latex foam layer has a hardness, density, or both that is different than that of the additional foam layer.

11. The pillow of claim 1, wherein the internal foam layer has a hardness, density, or both that is different than that of the latex foam layer, the additional foam layer, or both the latex foam layer and the additional foam layer.

12. The pillow of claim 7, wherein the cover is comprised of a flame-retardant material.

13. The pillow of claim 7, wherein the cover is comprised of a textile.

14. A pillow, comprising:

an internal foam layer having a first upper surface and a second lower surface opposite the first upper surface, the first upper surface and the second lower surface of the internal foam layer extending from a first longitudinal edge of the internal foam layer to a second longitudinal edge of the internal foam layer; and an outer foam layer substantially surrounding the internal foam layer, the outer foam layer including a latex foam portion and an additional foam portion, wherein the outer foam layer forms a first longitudinal edge of the pillow, the first longitudinal edge having an arcuate shape and extending around the first longitudinal edge of the internal foam layer from the first upper surface of the internal foam layer to the second lower surface of the internal foam layer; and wherein the outer foam layer forms a second longitudinal edge of the pillow, the second longitudinal edge having a second arcuate shape and extending around the second longitudinal edge of the internal foam layer from the first upper surface of the internal foam layer to the second lower surface of the internal foam layer;

further wherein a first group of columnar voids are disposed in an upper surface of said outer foam layer, said first group of columnar voids being substantially perpendicular to said upper surface of said internal foam layer, a second group of columnar voids disposed on said arcuate shapes of said outer foam layer, said second group of columnar voids being angled relative to said first group of columnar voids, each of said columnar voids extending from proximate to said internal foam layer to spaced from the internal foam layer;

an additional foam layer devoid of columnar voids positioned adjacent to the second lower surface of the internal foam layer, side surfaces of said additional foam layer directly engaging ends of outer foam layer such that the outer foam layer and the additional foam layer are disposed about the internal foam layer.

15. The pillow of claim 14, wherein the additional foam portion is positioned adjacent to the first surface and the second surface of the internal foam layer, and wherein the latex foam portion forms the first longitudinal edge of the pillow and the second longitudinal edge of the pillow.

16. A pillow, comprising:

an internal foam layer having a first upper surface and a second lower surface opposite the first upper surface, the first upper surface and the second lower surface of the internal foam layer extending from a first longitudinal edge of the internal foam layer to a second longitudinal edge of the internal foam layer;

a first outer foam layer substantially covering the first upper surface of the internal foam layer and extending around the first longitudinal edge of the internal foam layer to the second lower surface of the internal foam layer to define a first arcuate portion;

a second outer foam layer substantially covering the second lower surface of the internal foam layer and further defining a second arcuate portion extending around the second longitudinal edge of the internal foam layer to the first surface of the internal foam layer to contact the first outer foam layer, such that the first outer foam layer and the second outer foam layer are disposed about the internal foam layer;

a first plurality of columnar voids disposed through a horizontal surface of said first outer foam layer, said first plurality of columnar voids being substantially vertical and generally perpendicular to said internal foam layer and wherein a horizontal portion of said second outer foam layer is devoid of columnar voids;

at least one of the first and second arcuate portions of the outer foam layers having a second plurality of columnar voids positioned an angle to the first plurality of columnar voids.

* * * * *